US006006708A

United States Patent [19]

Ken et al.

[11] Patent Number: 6,006,708

[45] Date of Patent: Dec. 28, 1999

[54] VALVE TIMING CONTROLLING APPARATUS FOR INTERNAL COMBUSTION ENGINE

[75] Inventors: Asakura Ken, Toyota; Mikame Kazuhisa, Nagoya, both of Japan

[73] Assignee: Toyota Jidosha Kabushiki Kaisha, Toyota, Japan

[21] Appl. No.: 09/129,610

[22] Filed: Aug. 5, 1998

[30] Foreign Application Priority Data

Aug. 5, 1997 [JP] Japan ..... 9-210859

[51] Int. Cl.[6] ..... F01L 1/34; F02D 13/02

[52] U.S. Cl. ..... 123/90.17; 123/90.31

[58] Field of Search ..... 123/90.15, 90.17, 123/90.31; 74/567, 568 R; 464/1, 2, 160

[56] References Cited

U.S. PATENT DOCUMENTS

| | | | |
|---|---|---|---|
| 5,400,747 | 3/1995 | Tabata et al. | 123/90.17 |
| 5,669,343 | 9/1997 | Adachi | 123/90.17 |
| 5,738,056 | 4/1998 | Mikame et al. | 123/90.17 |
| 5,794,577 | 8/1998 | Kira | 123/90.17 |
| 5,823,152 | 10/1998 | Ushida | 123/90.17 |
| 5,836,275 | 11/1998 | Sato | 123/90.17 |
| 5,870,983 | 2/1999 | Sato et al. | 123/90.17 |

FOREIGN PATENT DOCUMENTS

| | | |
|---|---|---|
| 0 799 976 | 10/1997 | European Pat. Off. . |
| 0 808 997 | 11/1997 | European Pat. Off. . |
| 1-92504 | 4/1989 | Japan . |
| 9-60508 | 3/1997 | Japan . |

*Primary Examiner*—Weilun Lo
*Attorney, Agent, or Firm*—Pillsbury Madison & Sutro LLP

[57] ABSTRACT

A VVT mechanism is comprised of an internal rotor 29 connected to a cam shaft 12 and a housing 28 connected to an output shaft of an engine, and is further provided with a lock mechanism 43, 49 for restricting the relative rotation of the internal rotor 29 and the housing 28. An electronic control unit (ECU) 17 controls the driving of the VVT mechanism 11, and when changing over the direction of the relative rotation at a specific relative angle of rotation for actuating the lock mechanism 43, 49, after executing holding control for supplying a predetermined amount of oil to the advanced-angle side and delayed-angle side hydraulic chambers for a predetermined time duration, the ECU 17 effects a changeover to advanced-angle control. During the changeover, oil pressure necessary for canceling the lock mechanism is constantly supplied, so that it is possible to prevent unprepared actuation of the lock mechanism.

4 Claims, 6 Drawing Sheets

VALVE TIMING CONTROLLING APPARATUS FOR INTERNAL COMBUSTION ENGINE

BACKGROUND OF INVENTION

The present invention relates to a valve timing controlling apparatus for an internal combustion engine for making variable the opening/closing timing of an intake valve or exhaust valve of the internal combustion engine.

The valve timing controlling apparatus for an internal combustion engine adjusts the opening/closing timing of the intake valve or exhaust valve by changing the rotational phase of a cam shaft. As a result, it becomes possible to maximize the opening/closing timing of the intake valve or exhaust valve in correspondence with the operating state of the internal combustion engine, such as the load or the number of revolutions. Accordingly, it is possible to improve the fuel consumption, output, emission, and the like of the internal combustion engine in a wide range of operating states.

Various types of variable valve timing mechanisms for changing the valve timing in the above-described manner are present, and "Valve Opening/Closing Adjusting Apparatus" disclosed in Unexamined Japanese Patent Application No. Hei. 1-92504 can be cited as one example.

The variable valve timing mechanism of the type such as the one described in the aforementioned publication has a first rotating body for receiving a driving force from the crank shaft of the internal combustion engine and a second rotating body which rotates integrally with the cam shaft.

In a recessed portion formed in either one of the two rotating bodies, vanes formed in the other rotating body are disposed. As the recessed portion is partitioned by the vanes, a first hydraulic chamber and a second hydraulic chamber are formed on both sides of each vane.

By changing the oil pressure within the first arid second hydraulic chambers, the second rotating body is made to undergo relative rotation with respect to the first rotating body. As a result of this relative rotation, the relative angle of rotation of the second rotating body changes with respect to the first rotating body, with the result that the opening/closing timing of the intake or exhaust valve opened or closed by the cam shaft is changed.

More specifically, when the first rotating body and the second rotating body are made to undergo relative rotation, oil pressure is supplied to either of the first and second hydraulic chambers, and oil pressure is released from the other hydraulic chamber at the same time. On the basis of the pressure difference occurring in the supply and release of the oil pressure, the vanes move toward the hydraulic chamber side of low oil pressure, so that the first rotating body undergoes relative rotation with respect to the second rotating body.

When the aforementioned relative angle of rotation assumes an appropriate phase, oil pressure control is effected so that the oil pressures in the first and second hydraulic chambers become uniform. Consequently, the movement of the vanes is restricted, and the relative angle of rotation is fixed.

The variable valve timing mechanism having the above-described construction is generally referred to as the "vane-type variable valve timing mechanism."

With this vane-type variable valve timing mechanism, there are cases where oil pressure cannot be sufficiently supplied to the variable valve timing mechanism such as at the time of starting the internal combustion engine, in which case the operation of the variable valve timing mechanism becomes unstable. To prevent this situation, as disclosed in Unexamined Japanese Patent Application No. Hei. 1-92504, a lock mechanism is provided to fix the relative rotation of the second rotating body with respect to the first rotating body when oil pressure supplied to the variable valve timing mechanism is insufficient such as at the time of starting the internal combustion engine.

As this lock mechanism, a mechanism is widely adopted which comprises a retaining hole formed in either of the two rotating bodies and a lock pin which is accommodated in an accommodating hole formed in the other rotating body and can be fitted into the retaining hole by being urged by a spring. The lock mechanism having such a lock pin is provided with a first unlocking hydraulic chamber and a second unlocking hydraulic chamber communicating with the aforementioned first and second hydraulic chambers. As oil pressure is supplied into these unlocking hydraulic chambers, the lock pin moves against the urging force of the spring, and is disengaged from the retaining hole, thereby canceling the locked state.

However, with the valve timing controlling apparatus having such a lock mechanism, at the time of changing over the direction of relative rotation of the second rotating body with respect to the first rotating body, there were cases where the cancellation of the locked state of the lock mechanism was impossible. Such a state in which unlocking is impossible hampers smooth valve timing control.

Hereafter, the mechanism of the occurrence of this problem will be described more specifically by citing an example.

Here, a description will be given of the case where a changeover is effected from the state in which the vanes are urged toward the second hydraulic chamber side by supplying oil pressure to the first hydraulic chamber to the state in which the vanes are urged toward the first hydraulic chamber side by supplying oil pressure to the second hydraulic chamber.

In an initial state, the interior of the first hydraulic chamber has been supplied with oil pressure, and oil pressure within the second hydraulic chamber has been released. At this time, on the basis of the oil pressure supplied into the first hydraulic chamber, the lock pin has been moved against the urging force of the spring, so that the lock mechanism is in the unlocked state.

In this state, if a control command is issued for changing over the direction of relative rotation, the oil pressure passage communicating with the first hydraulic chamber is opened, and the supply of oil pressure to the oil pressure passage communicating with the second hydraulic chamber is started at the same time. Consequently, the locked state of the lock mechanism is canceled on the basis of the release of oil pressure in the first hydraulic chamber and the first unlocking hydraulic chamber communicating with that hydraulic chamber is discharged, the supply of oil pressure into the second hydraulic chamber, and the supply of oil pressure into the second unlocking hydraulic chamber.

However, in reality the above-described series of operation is not carried out simultaneously, and is accompanied by slight time lags.

The release of the oil pressure in the first hydraulic chamber and the first unlocking hydraulic chamber communicating therewith is effected immediately.

Since the supply of oil pressure into the second hydraulic chamber is executed by lagging behind the release of the oil pressure from the first hydraulic chamber and the like since the flow of oil into the second hydraulic chamber is started after the oil pressure passage communicating with the second hydraulic chamber is first filled with the oil pressure.

The cancellation of the locked state of the lock mechanism on the basis of the supply of oil pressure to the second unlocking hydraulic chamber is executed by further lagging behind the aforementioned supply of oil pressure to the second hydraulic chamber.

Thus there is a time lag from the time there ceases to be no oil pressure in the first unlocking hydraulic chamber until the oil pressure in the second unlocking hydraulic chamber rises to a sufficient level. For this reason, at the time of directly changing over the direction of relative rotation of the second rotating body with respect to the first rotating body, unlocking is impossible even though temporarily.

Therefore, if the aforementioned direction of relative rotation is changed over at a relative angle of rotation at which the positions of the lock pin and the retaining hole are aligned with each other, the lock pin may be fitted into the retaining hole temporarily.

Furthermore, a situation can also occur in which the oil pressure within the second hydraulic chamber rises and the relative rotation of the second rotating body with respect to the first rotating body is started, before the oil pressure within the second unlocking hydraulic chamber rises and the lock pin is completely disengaged from the retaining hole. In such a case, since the lock pin is caught, the lock pin cannot be disengaged from the retaining hole, so that the relative rotation of the second rotating body with respect to the first rotating body cannot be effected smoothly.

SUMMARY OF INVENTION

The present invention has been devised in view of these actual circumstances, and an object of the invention is to provide a valve timing controlling apparatus having high reliability by effecting smooth valve timing control.

To achieve the above-described objectives, according to a first aspect of the present invention, there is provided a valve timing controlling apparatus for an internal combustion engine. This apparatus comprises: a first rotating body for receiving a rotatively driving force of the internal combustion engine; a second rotating body whose relative angle of rotation with respect to the first rotating body is displaceable; relative-angle-of-rotation changing means for changing the relative angle of rotation of the second rotating body with respect to the first rotating body by oil pressure; locking means which is subjected to changeover control by oil pressure between an allowed state in which the relative rotation of the first rotating body and the second rotating body is allowed and a nonallowed state in which it is not allowed in a state of a specific relative angle of rotation of the second rotating body with respect to the first rotating body; and oil-pressure-supply controlling means for controlling the oil pressure for operating the relative-angle-of-rotation changing means for controlling the oil pressure for operating the relative-angle-of-rotation changing means and the oil pressure for operating the lock mechanism, so as to transmit the rotatively driving force of the internal combustion engine to a cam shaft for driving the intake valve or the exhaust valve by means of the first rotating body and the second rotating body, wherein the relative angle of rotation is controlled by effecting any one of first oil pressure control for delaying the relative angle of rotation of the second rotating body, second oil pressure control for advancing the relative angle of rotation of the second rotating body, and third oil pressure control for holding the relative angle of rotation of the second rotating body, the lock mechanism is restricted to the allowed state by at least the third oil pressure control, the lock mechanism is restricted to the nonallowed state when none of the first oil pressure control, the second oil pressure control, and the third oil pressure control is effected, and when the first oil pressure control or the second oil pressure control is started in the state of the specific relative angle of rotation, the third oil pressure control is effected to set the lock mechanism in the allowed state before effecting the first oil pressure control or the second oil pressure control.

According to a second aspect of the invention, there is provided the valve timing controlling apparatus for an internal combustion engine of the first aspect of the invention, wherein when a changeover is effected from one of the first oil pressure control and the second oil pressure control to the other control, the third oil pressure control is effected to set the lock mechanism in the allowed state before effecting the other oil pressure control.

According to a third aspect of the invention, there is provided the valve timing controlling apparatus for an internal combustion engine of either first or second aspect, wherein the specific relative angle of rotation is in a state of a most delayed angle, and when the second oil pressure control is started, the third oil pressure control is effected to set the lock mechanism in the allowed sates before effecting the second oil pressure control.

BRIEF DESCRIPTION OF THE DRAWINGS

FIG. 1 is a cross-sectional view illustrating an intake cam shaft, a VVT mechanism, and the like;

FIG. 7 is an enlarged cross-sectional view illustrating a lock pin, a retaining hole, and the like;

FIGS. 8A and 8B are enlarged cross-sectional views illustrating a lock pin, a pressure oil passage, and the like.

DETAILED DESCRIPTION OF PREFERRED EMBODIMENTS

Hereafter, a description will be given of an embodiment in which the present invention is embodied as a valve timing controlling apparatus provided in a multi-cylinder gasoline engine.

Figure 1:
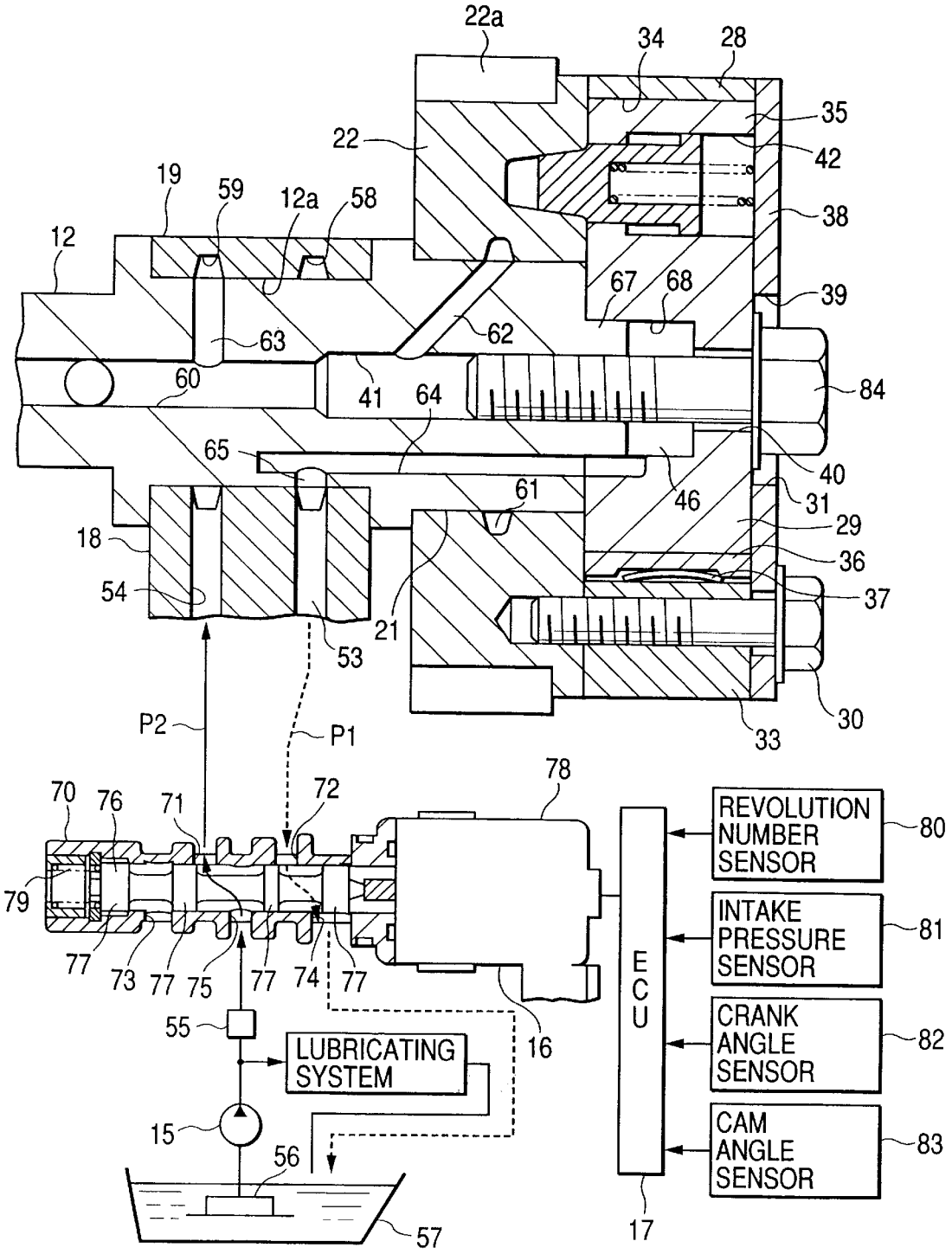

FIG. 1 shows a variable valve timing mechanism (hereafter referred to as the "VVT mechanism") 11, an oil pump 15 for supplying oil through oil passages P1 and P2, an oil control valve (hereafter referred to as the "OCV") 16 provided midway in each of the oil passages P1 and P2, and an electronic control unit (hereafter referred to as the "ECU") 17 for controlling the OCV 16 in correspondence with the operating state of the engine, and so forth.

Figure 6:
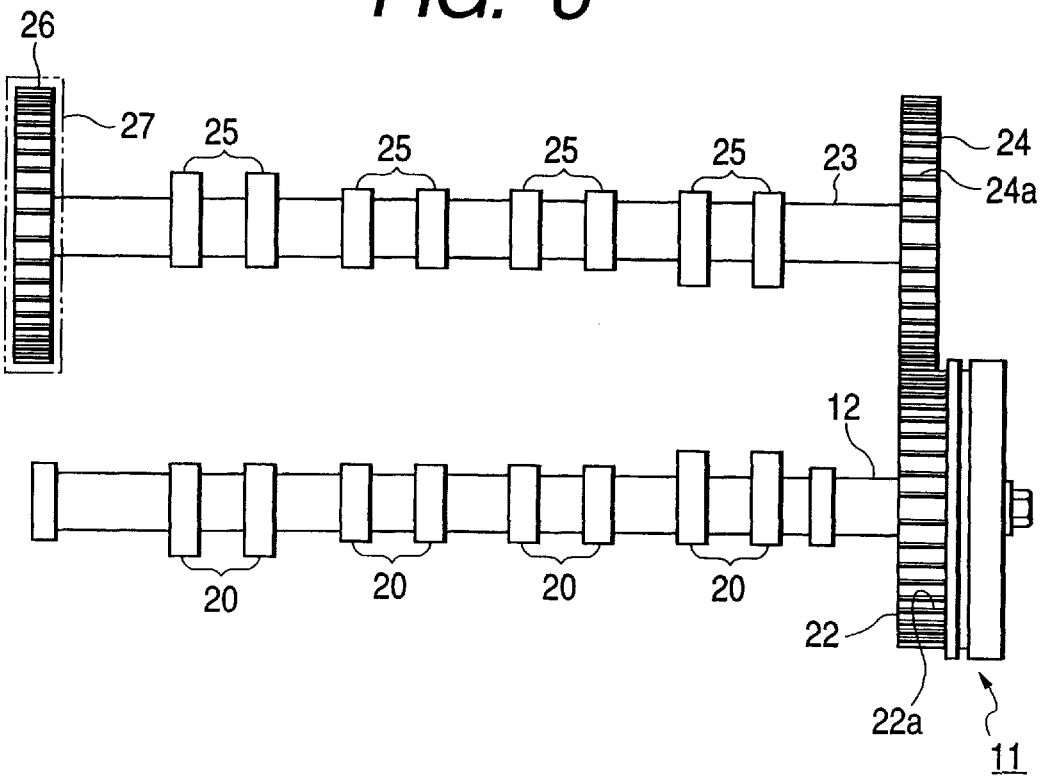
FIG. 6 is a plan view illustrating the intake cam shaft and an exhaust cam shaft.

A journal 12*a* of an intake-side cam shaft 12 is rotatably supported by an upper end face of a cylinder head 18 and a bearing cap 19. As shown in FIG. 6, four pairs of cams 20 are provided on an outer peripheral portion of a proximal end side (right-hand side in FIG. 6) of the intake-side cam shaft 12. These cams 20 rotate together with the intake-side cam shaft 12 so as to open and close intake valves (not shown) respectively provided for the cylinders.

Figure 3:
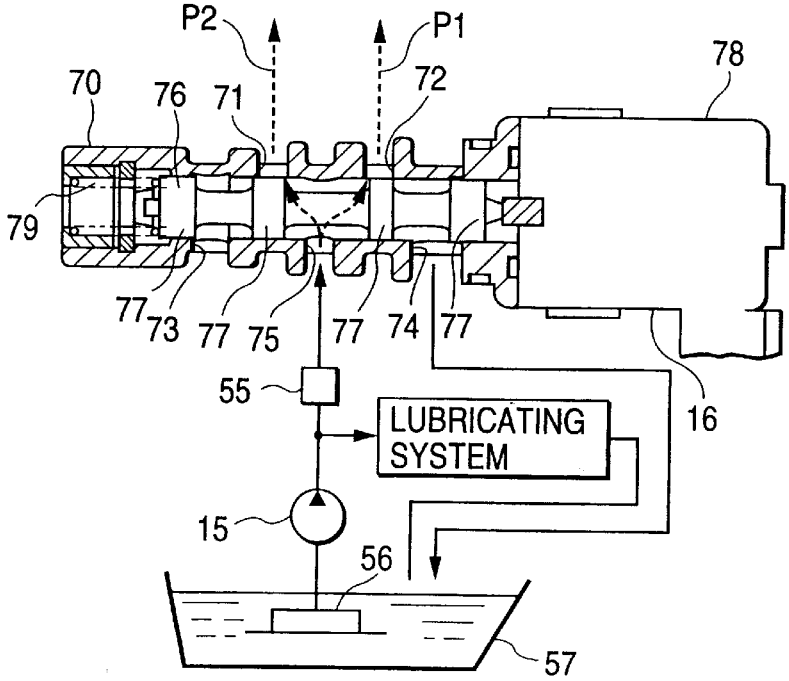
FIG. 3 is a cross-sectional view illustrating the OCV.

In the intake-side cam shaft 12, an enlarged-diameter portion 21 is formed on a portion located more on the proximal end side than the journal 20*a*. A driven gear 22 is rotatably mounted on the outer periphery of the enlarged-diameter portion 21. A plurality of outer teeth 22*a* are formed on the outer peripheral portion of the driven gear 22. As shown in FIG. 3, the outer teeth 22*a* mesh with outer teeth 24*a* of a drive gear 24 provided on an exhaust-side cam shaft 23. Four pairs of cams 25 are formed on the exhaust-side cam shaft 23 in the same way as the intake-side cam shaft 12. These cams 25 rotate together with the exhaust-side cam shaft 23 so as to open and close unillustrated exhaust valves respectively provided for the cylinders.

The exhaust-side cam shaft 23 is rotatably supported by the cylinder head 18 and the bearing cap (not shown) in the same way as the intake-side cam shaft 12. A cam pulley 26 is fixed to one end portion of the exhaust-side cam shaft 23, and a timing belt 27 is wound around the pulley 26. The timing belt 27 is wound around a crank pulley (not shown) mounted on the crank shaft (not shown).

When the operation of the engine is started, the rotatively driving force of the crank shaft is transmitted to the exhaust-side cam shaft 23 via the cam pulley 26. At the same time, the rotatively driving force is transmitted to the intake-side cam shaft 12 via the drive gear 24 and the VVT mechanism 11.

Figure 4:
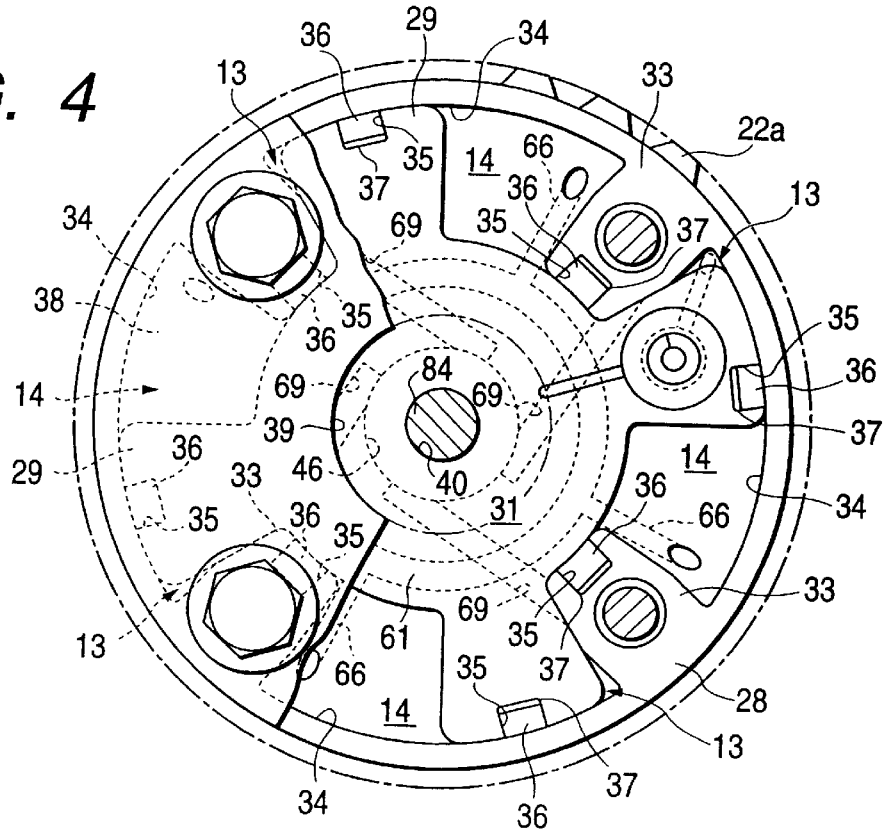
FIG. 4 is a cross-sectional view of the VVT mechanism.

As shown in FIG. 4, the VVT mechanism 11 i provided with a hollow cylindrical housing 28 and an internal rotor 29 disposed in the housing 28. The internal rotor 29 has a cylindrical portion 31 located in the center of the internal rotor 29 and four vanes 32 formed in such a manner as to project from the outer periphery of the cylindrical portion 31. The vanes 32 are arranged at equiangular intervals around the axis L of the intake-side cam shaft 12.

On the inner side of the housing 28, four projections 33 are formed at positions spaced apart predetermined intervals in the circumferential direction of the intake-side cam shaft 12 in such a manner as to project toward the axis of the intake-side cam shaft 12. Distal end faces of these projections 33 are in sliding contact with the outer peripheral surface of the cylindrical portion 31. Grooves 34 are formed between adjacent ones of the projections 33, and the vanes 32 are respectively located in the grooves 34.

The distal end faces of the vanes 32 are in sliding contact with the inner peripheral wall of the housing 28. As shown in FIG. 4, outer peripheral grooves 35 and 85 having rectangular cross sections are formed at distal end faces of the vanes 32 and at distal end faces of the projections 33. Seal members 36 and 86 are located in the outer peripheral grooves 35 and 85, and the seal members 36 and 86 are urged by leaf springs 37 and 87 in the direction of being disengaged from the grooves 35 and 85 in the radial direction of the intake-side cam shaft 12. Consequently, the distal end faces of the vanes 32 and the inner peripheral surface of the housing 28 are sealed by the seal members 36 and 86. Further, the movement of oil between an advanced-angle side hydraulic chamber 13 and a delayed-angle side hydraulic chamber 14 is restricted.

As shown in FIG. 1, the housing 28 has one end face abutting against one end face (the right-hand end face in FIG. 1) of the driven gear 22. A disk-shaped cover 38 is provided in such a manner as to cover the outer end faces of the housing 28 and the internal rotor 29. An insertion hole 39 is formed in a central portion of the cover 38. Further, an insertion hole 40 is formed in a central portion of the cylindrical portion 31, and a mounting bolt 84 is inserted in the insertion holes 39 and 40. The mounting bolt 84 is threadedly engaged in a bolt hole 41 formed in a distal end portion of the intake-side cam shaft 12. As a result, the internal rotor 29 is fixed to the distal end portion of the intake-side cam shaft 12. A recess portion and a projecting portion which are not illustrated are respectively formed in the internal rotor 29 and the intake-side cam shaft 12. Through the relationship of the recess and the projection, the two members 29 and 12 rotate as a unit. The driven gear 22, the housing 28, and the cover 38 are integrally fixed by a plurality of bolts 30. Accordingly, the housing 28, the driven gear 22, and the cover 38 are integrally rotatably about the axis of the intake-side cam shaft 12. The driven gear 22 and the housing 28 constitute a first rotating body, and the internal rotor 29 constitutes a second rotating body.

Four spaces surrounded by the cover 38 and the respective end faces of the driven gear 22 and by the inner peripheral walls of the grooves 34 are formed inside the housing 28. These spaces are partitioned into the advanced-angle side hydraulic chambers 13 and the delayed-angle side hydraulic chambers 14 by the vanes 32 disposed in the grooves 34. The internal rotor 29 is rotatable in both directions about the axis of the intake-side cam shaft 12 in correspondence with the magnitude of the pressure of the oil supplied to the hydraulic chambers 13 and 14.

When the internal rotor 29 rotates in the same direction as the rotating direction of the intake-side cam shaft 12 (hereafter this rotating direction will be referred to as the "rotating direction of the advanced angle"), the rotational phase of the intake-side cam shaft 12 fixed to the internal rotor 29 is advanced with respect to the driven gear 22, thereby advancing the opening/closing timing of the intake valved. When the internal rotor 29 rotates in the opposite direction to the rotating direction of the intake-side cam shaft 12 (hereafter this rotating direction will be referred to as the "rotating direction of the delayed angle"), the rotational phase of the intake-side cam shaft 12 is delayed with respect to the driven gear 22, thereby delaying the opening/closing timing of the intake valve.

Figure 7:
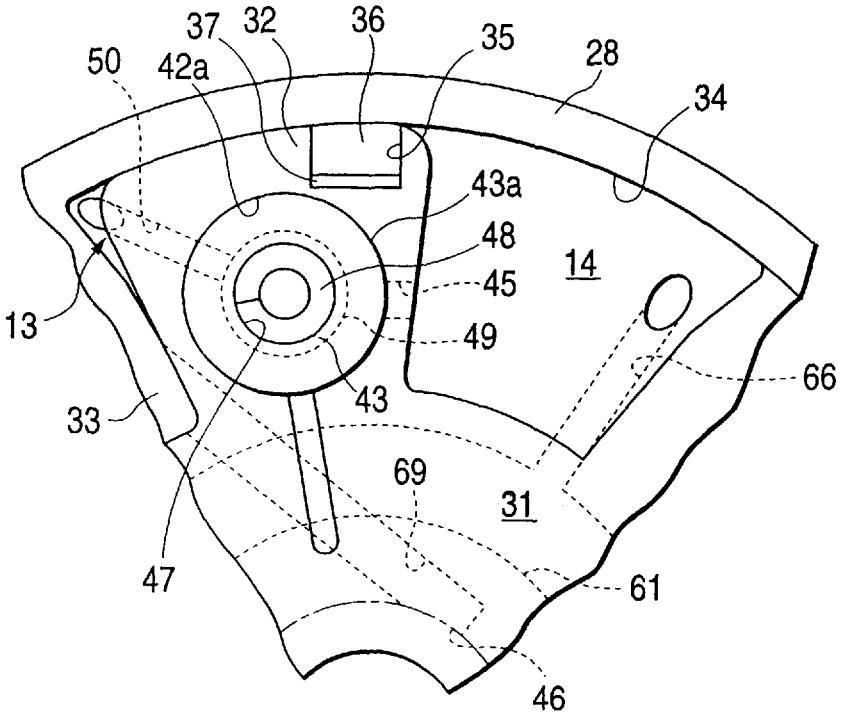
Figure 8A:
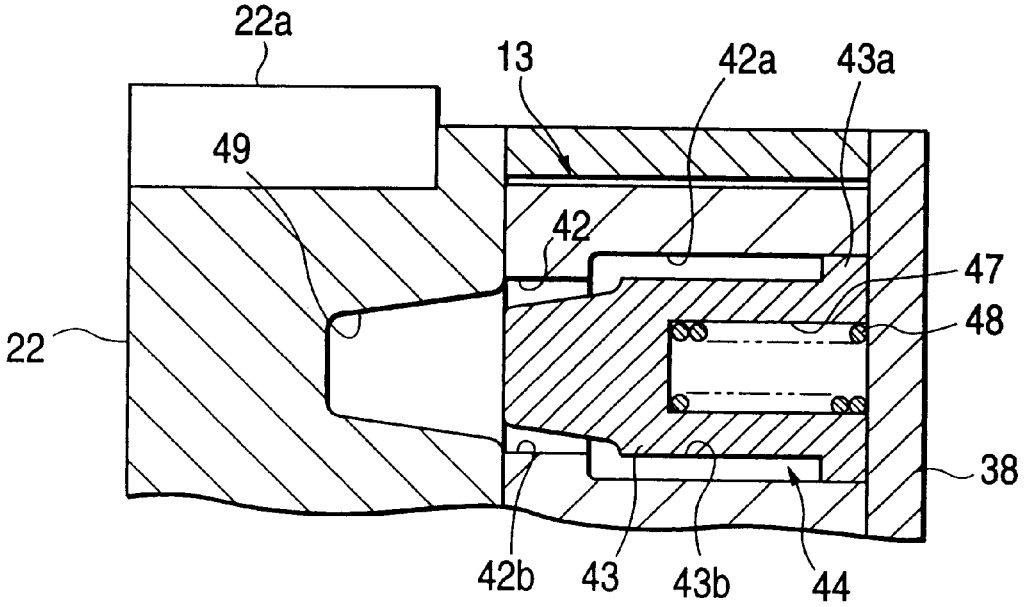
Figure 8B:
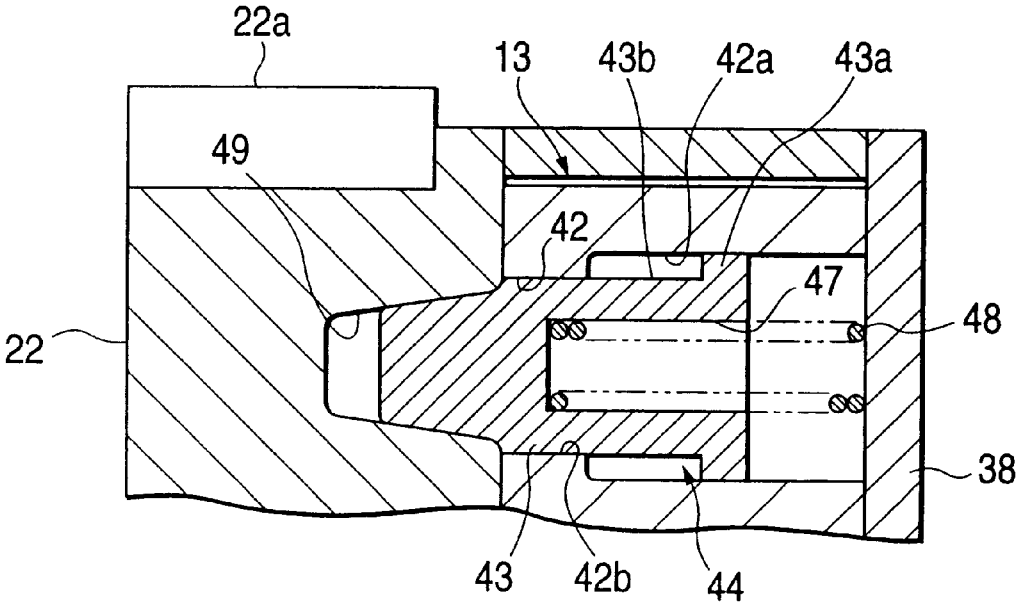

As shown in FIG. 7, a through hole 42 with a circular cross section extending in the axial direction of the intake-side cam shaft 12 is formed in one of the vanes 32, and a lock pin 43 is disposed in the through hole 42. The through hole 42 is formed by a large-diameter portion 42*a* and a small-diameter portion 42*b*. The lock pin 43 has a hollow cylindrical shape with a bottom and is formed by a large-diameter portion 42*a* and a small-diameter portion 42*b*. The large-diameter portion 43*a* of the lock pin 43 is slidably fitted in the large-diameter portion 42*a* of the through hole 42, and the small-diameter portion 43*b* is slidably fitted in the small-diameter portion 42*b*.

In the through hole 42, the space between the large-diameter portion 42*a* thereof and the small-diameter portion 43*b* of the lock pin 43 is formed as a hydraulic chamber 44. The hydraulic chamber 44 communicates with one of the delayed-angle side hydraulic chambers 14 through a first pressure oil passage 45 formed in a side portion of the internal vane 32, so that part of the oil in the delayed-angle side hydraulic chamber 14 can be supplied into the hydraulic chamber 44.

An accommodating space 47 extending in the axial direction is formed in the lock pin 43, and a spring 48 is disposed in the accommodating space 47. The lock pin 43 is urged toward the proximal end side of the intake-side cam shaft 12 by the spring 48.

A retaining hole 49 is formed in an end face of the driven gear 22 opposing the internal rotor 29. A distal end portion of the lock pin 43 can be fitted into this retaining hole 49. When the lock pin 43 urged by the spring 48 is fitted into the retaining hole 49, the relative rotation of the internal rotor 29 and the driven gear 22 is restricted. As a result, the internal rotor 29 rotates integrally with the driven gear 22 and the housing 28. The lock pin 43, the spring 48, and the retaining hole 49 constitute a lock mechanism.

As shown in FIG. 7, the retaining hole 49 communicates with one of the advanced-angle side hydraulic chambers 13 through a second pressure oil passage 50 formed in the driven gear 22, so that part of the oil in the advanced-angle side hydraulic chamber 13 can be supplied into the retaining hole 49.

When the lock pin 43 is fitted into the retaining hole 49, both the internal rotor 29 and the housing 28 are held in the positional relationship shown in FIG. 4. That is, the internal rotor 29 is disposed inside the housing 28 at a position where the rotational phase of the intake-side cam shaft 12 assumes the most delayed state with respect to the housing 28 (hereafter this position of the internal rotor 29 will be referred to as the "position of the most delayed angle").

Hereafter, a description will be given of the advanced-angle side oil passage P1 and the delayed-angle side oil passage P2 for supplying oil to the advanced-angle side hydraulic chamber 13 and the delayed-angle side hydraulic chamber 14, as well as the arrangement of the OCV 16 and the like.

As shown in FIG. 1, an advanced-angle side head oil passage 53 and a delayed-angle side head oil passage 54 are formed inside the cylinder head 18. The advanced-angle side head oil passage 53 communicates with the oil passage P1, while the delayed-angle side head oil passage 54 communicates with the oil passage P2. The head oil passages 53 and 54 are connectable to an oil pan 57 by means of the OCV 16, an oil filter 55, an oil pump 15, an oil strainer 56. When the oil pump 15 is driven in conjunction with the running of the engine, the oil stored in the oil pan 57 is sucked by the oil pump 15. The oil is led into the oil pump 15 through the oil strainer 56, and is pressurized and discharged from the oil pump 15. The pressurized and discharged oil is sent to the OCV 16 through the oil filter 55, and the oil thus sent is selectively supplied to the head oil passages 53 and 54 by the OCV 16.

Annular oil grooves 58 and 59 corresponding to the positions of the openings of the head oil passages 53 and 54 are respectively formed in an upper end portion of the cylinder head 18 and the bearing cap 19.

Inside the intake-side cam shaft 12, a delayed-angle side shaft oil passage 60 extending in its axial direction is formed. The delayed-angle side shaft oil passage 60 communicates with the bolt hole 41. In the driven gear 22, an annular circumferential groove 61 is formed along the outer periphery of the enlarged-diameter portion 12*a* of the intake-side cam shaft 12, and the circumferential groove 61 and the delayed-angle side shaft oil passage 60 communicate with each other through a communicating oil passage 62.

A delayed-angle side oil hole 63 extending in the radial direction of the intake-side cam shaft 12 is formed inside the journal 12*a*. The delayed-angle side shaft oil passage 60 communicates with the oil groove 59 through this delayed-angle side oil hole 63. Accordingly, the oil in the delayed-angle side head oil passage 54 is supplied into the delayed-angle side shaft oil passage 60 through the oil groove 59 and the delayed-angle side oil hole 63.

An advanced-angle side shaft oil passage 64 extending in parallel with the axial direction is formed inside the intake-side cam shaft 12. An advanced-angle side oil hole 65 extending in the radial direction of the intake-side cam shaft 12 is formed inside the journal 12*a*. The advanced-angle side shaft oil passage 64 communicates with the oil groove 58 through the advanced-angle side oil hole 65. Accordingly, the oil in the advanced-angle side head oil passage 53 is supplied into the advanced-angle side shaft oil passage 64 through the oil groove 58 and the advanced-angle side oil hole 65.

Figure 5:
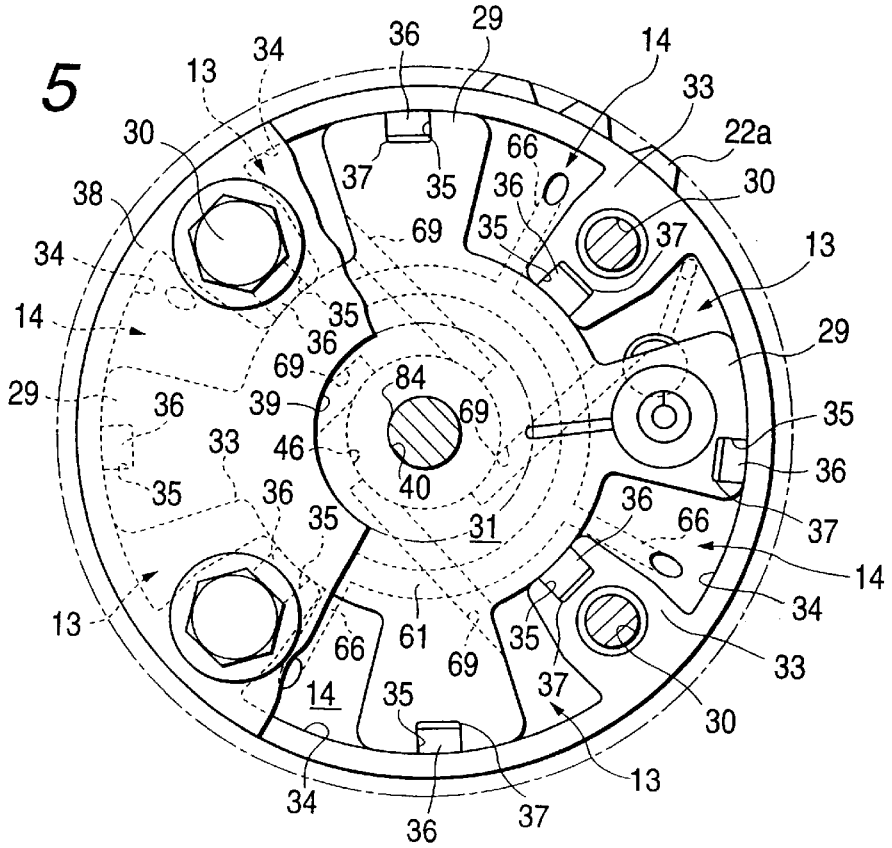
FIG. 5 is a cross-sectional view of the VVT mechanism.

As shown in FIGS. 4 and 5, four delayed-angle side supply passages 66 extending in the radial direction are formed inside the driven gear 22. The delayed-angle side supply passages 66 communicate with the circumferential groove 61 and the delayed-angle side hydraulic chambers 14. The oil supplied into the circumferential groove 61 from the delayed-angle side shaft oil passage 60 through the communicating oil passage 62 is supplied into the delayed-angle side hydraulic chambers 14 through the delayed-angle side supply passages 66.

As shown in FIG. 1, a projecting portion 67 is formed on the distal end face of the enlarged-diameter portion 21 of the intake-side cam shaft 12. A hole 68 for fitting with the projecting portion 67 is formed in the end face of the internal rotor 29 opposing the end face of the enlarged-diameter portion 21. The hole 68 surrounds the mounting bolt 84, and the interior of the hole 68 forms an annular advanced-angle side annular passage 46. The advanced-angle side shaft oil passage 64 is open in the advanced-angle side annular passage 46.

As shown in FIGS. 4 and 5, four advanced-angle side oil supply holes 69 extending in the radial direction are formed inside the internal rotor 29. The inner peripheral sides of the advanced-angle side oil supply holes 69 communicate with the advanced-angle side annular passage 46 and the advanced-angle side hydraulic chambers 13. Accordingly, the oil supplied into the advanced-angle side shaft oil passage 64 is supplied into the advanced-angle side hydraulic chambers 13 through the advanced-angle side oil supply holes 69.

As the opening of the OCV 16 is subjected to duty control, the OCV 16 controls the oil pressure supplied to the advanced-angle side hydraulic chambers 13 and the delayed-angle side hydraulic chambers 14. Hereafter, a description will be given of the arrangement of the OCV 16.

A casing 70 forming the OCV 16 has first to fifth ports 71 to 75. The first port 71 communicates with the delayed-angle side head oil passage 54, and the second port 72 communicates with the advanced-angle side head oil passage 53. In addition, the third and fourth ports 73 and 74 communicate with the oil pan 57, and the fifth port 75 communicates with the discharge side of the oil pump 15 through the oil filter 55.

Figure 2:
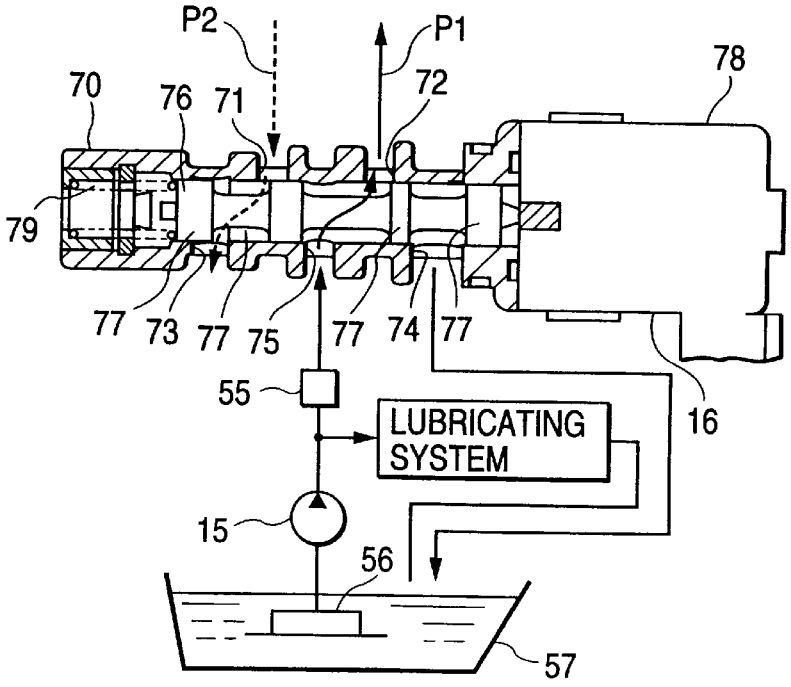
FIG. 2 is a cross-sectional view illustrating an OCV.

A spool 76 is provided inside the casing 70 in such a manner as to be capable of reciprocating in its axial direction. The spool 76 has four cylindrical valve elements 77. The casing 70 is provided with an electromagnetic solenoid 78 for moving the spool from a first operating position shown in FIG. 2 to a second operating position shown in FIG. 1. A spring 79 is provided in the casing 70, and the spool 76 is urged toward the first operating position by this spring 79.

The OCV 16 is controlled by the ECU 17 shown in FIG. 1. Connected to the ECU 17 are a revolution number sensor 80 for detecting the operating state of the engine, an intake pressure sensor 81, and a crank angle sensor 82 and a cam angle sensor 83 for detecting the rotational phase angle of the intake-side cam shaft 12. The ECU 17 detects the operating state of the engine and the rotational phase of the intake-side cam shaft 12 on the basis of detection signals of the sensors 80 to 83. Further, the ECU 17 determines the deviation between the actual rotational phase angle in the intake-side cam shaft 12 and a targeted rotational phase angle suitable for the operating state of the engine, and controls the OCV 16 and the VVT mechanism 11 so that the deviation is set to a predetermined value or less.

Hereafter, a description will be given of control of the operation of the OCV 16 effected by the ECU 17.

First, a description will be given of a case where the actual rotational phase angle is advanced with respect to the targeted rotational phase angle.

At this time, the ECU 17 issues a command signal so that a current value supplied to the electromagnetic solenoid 78 provided in the OCV 18 is set to a maximum value. Hereafter, this command signal will be referred to as the 100% duty signal. Since the current value supplied to the electromagnetic solenoid 78 becomes maximum, the spool 76 moves to the second operating position shown in FIG. 1 against the urging force of the spring 79. As a result, the first port 72 and the fifth port 75 communicate with each other, and the second port 72 and the fourth port 74 communicate with each other. Accordingly, oil pressure is supplied to the delayed-angle side hydraulic chambers 14, while the oil in the advanced-angle side hydraulic chambers 13 is recirculated to the oil pan 57. Consequently, the vanes 32 are urged by the oil pressure within the delayed-angle side hydraulic chambers 14 which increased relative to the oil pressure in the advanced-angle side hydraulic chambers 13, so that the internal rotor 29 is rotated in the rotating direction of the intake-side cam shaft 12.

The above-described control will be hereafter referred to as the delayed-angle control as the first oil pressure control.

Next, a description will be given of a case where the actual rotational phase angle is delayed relative to the targeted rotational phase angle.

At this time, the ECU 17 issues a command signal so that a current value supplied to the electromagnetic solenoid 78 provided in the OCV 18 is set to zero. Hereafter, this command signal will be referred to as the 0% duty signal. Since the current value supplied to the electromagnetic solenoid 78 becomes zero, the spool 76 moves to the first operating position shown in FIG. 2 by the urging force of the spring 79. As a result, the second port 72 and the fifth port 75 communicate with each other, and the first port 71 and the third port 73 communicate with each other. Accordingly, oil pressure is supplied to the advanced-angle side hydraulic chambers 13, while the oil in the delayed-angle side hydraulic chambers 14 is recirculated to the oil pan 57. Consequently, the vanes 32 are urged by the oil pressure within the advanced-angle side hydraulic chambers 13 which increased relative to the oil pressure in the delayed-angle side hydraulic chambers 14, so that the internal rotor 29 is rotated in the opposite direction to the rotating direction of the intake-side cam shaft 12.

The above-described control will be hereafter referred to as the advanced-angle control as the second oil pressure control.

Next, a description will be given of a case where the actual rotational phase angle coincides with the targeted rotational phase angle.

At this time, the ECU 17 issues a command signal so that a current value supplied to the electromagnetic solenoid 78 provided in the OCV 18 is set to a predetermined current value. Hereafter, this command signal will be referred to as the holding duty signal. Since the current value supplied to the electromagnetic solenoid 78 becomes the predetermined current value, the spool 76 moves to the intermediate holding position shown in FIG. 3 through the balance of the urging force of the spring 79 and the urging force generated by the electromagnetic solenoid 78. At this time, the first port 71 and the second port 72 communicate with each other. Accordingly, predetermined amounts of oil are supplied to the advanced-angle side hydraulic chambers 13 and the delayed-angle side hydraulic chambers 14. Consequently, since balance is established between the oil pressure within the delayed-angle side hydraulic chambers 14 and the oil pressure within the advanced-angle side hydraulic chambers 13, the urging force applied to the vanes 32 is offset, so that the internal rotor 29 is held in the present rotational phase.

The above-described control will be hereafter referred to as the holding control as the third oil pressure control.

It should be noted that the reason for supplying oil pressure to the two hydraulic chambers 13 and 14 even when the rotational phase is being held is based on the following reason.

Slight clearances are provided between movable members of the VVT mechanism 11 and the like so as to ensure their operation. Oil constantly leaks from these clearances. If the supply of oil pressure to the two hydraulic chambers 13 and 14 is stopped, the oil pressure within the hydraulic chambers 13 and 14 declines gradually due to the leakage of oil. If the state is left as it is, the oil pressure within the hydraulic chambers 13 and 14 ultimately becomes unable to hold the rotated position of the internal rotor 29. Therefore, to replenish the oil which leaked, it is necessary to supply the oil even during the aforementioned holding.

With the above-described valve timing controlling apparatus in accordance with this embodiment, the rotational phase angle is altered by appropriately effecting a changeover among the above-described three modes of operation control.

Figure 9:
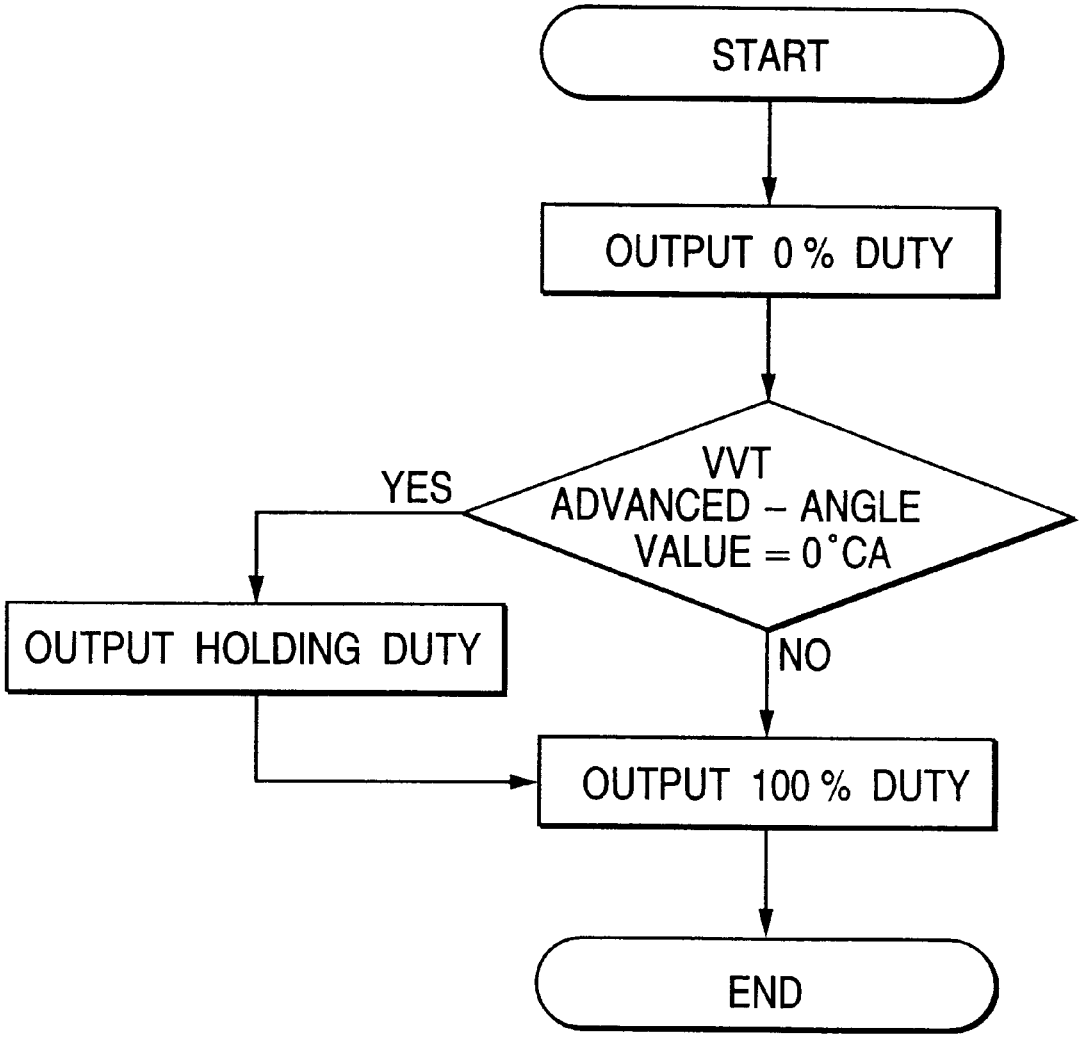
FIG. 9 is a flowchart illustrating an auxiliary control routine.

In this embodiment, in the changeover from delayed-angle control to advanced-angle control, auxiliary control is carried out for overcoming the trouble in which the cancellation of the aforementioned lock mechanism is temporarily stopped. Referring now to the flowchart shown in FIG. 9, a description will be given of this auxiliary control. It should be noted that this flowchart is based on the precondition that the ECU 17 is in a controlling state for effecting a changeover from delayed-angle control to advanced-angle control.

Since delayed-angle control is being performed, the interior of the delayed-angle side hydraulic chambers 14 has been supplied with oil. In addition, the interior of the hydraulic chamber 44 has also been supplied with oil through the first pressure passage 45. By the oil pressure in this hydraulic chamber 44, the lock pin 43 is moved in the direction of being disengaged from the retaining hole 49 against the urging force of the spring 48.

On the basis of an output signal from the cam angle sensor 83, the ECU 17 calculates the relative angle of rotation of the present internal rotor 29 and the driven gear 22. It should be noted that this relative angle of rotation uses as a reference the position of the most delayed angle, i.e., the position where the lock pin 43 and the retaining hole 49 are aligned with each other and the lock mechanism can be actuated, and this relative angle of rotation is quantized as the relative angle of rotation of the internal rotor 29 from that position. Hereafter, this value will be referred to as the VVT advanced-angle value, its unit is set as "° CA," and the relative angle of rotation which is at a specific relative angle of rotation at the position of the most delayed angle is defined as "0° CA."

The ECU 17 determines whether the calculated VVT advanced-angle value is "0° CA" or a value other than the same. If the VVT advanced-angle value is a value other than "0° CA," the ECU 17 outputs the 100% duty signal as it is, and the operation immediately shifts to the advanced-angle control.

On the other hand, if the VVT advanced-angle value is 0° CA, the ECU 17 outputs the holding duty signal for a fixed time duration. During this period, oil is supplied to the two oil passages P1 and P2 on the advanced-angle and delayed-angle sides. Accordingly, oil is supplied into the advanced-angle side hydraulic chambers 13 in addition to the delayed-angle side hydraulic chambers 14. Further, oil pressure is also supplied into the retaining hole 49 through the second pressure passage 50. Hence, by both the oil pressure within the hydraulic chamber 44 and the oil pressure within the retaining hole 49, the lock pin 43 is moved in the direction of being disengaged from the retaining hole 49 against the urging force of the spring 48.

The time duration when the holding duty signal is being outputted is the time necessary for the oil pressure within the retaining hole 49 to increase to such an extent that it overcomes the urging force of the spring 48.

After this holding duty signal is outputted for the predetermined time duration, the ECU outputs the 100% duty signal, and the operation shifts to the advanced-angle control. Although the oil pressure within the within the hydraulic chamber 44 declines due to this shift, since the oil pressure within the retaining hole 49 has already increased by this time, the lock pin 43 is able to maintain the present disengaged state against the urging force of the spring 48.

The above-described auxiliary control is also executed during the starting of the engine. A description will be given hereafter of the operation of the valve timing controlling apparatus during the starting of the engine.

During the starting of the engine, the VVT mechanism 11 at the position of the most-delayed angle, and the lock pin 43 is fitted in the retaining hole 49 and is thus set in the state in which the rotational phase is fixed. This is based on the following reason.

First, if the ECU 17 detects the operation stop of the engine on the basis of the fact that the unillustrated ignition switch is set to OFF, the ECU 17 outputs the 0% duty signal and effects the delayed-angle control.

As a result, the position of the relative rotation of the internal rotor 29 with respect to the housing 28 becomes the position of the most delayed angle shown in FIG. 4. This is because since the oil ceases to be discharged from the oil pump 15, the oil pressure within the advanced-angle side hydraulic chambers 13 and the delayed-angle side hydraulic chambers 14 declines, so that the internal rotor 29 ceases to be held by the oil pressure within the hydraulic chambers 13 and 14.

In addition, when the driving of the oil pump 15 is stopped, the oil pressure within the hydraulic chamber 44 and the retaining hole 49 declines. Consequently, the lock pin 43 is moved toward the proximal end side of the intake-side cam shaft 12 by the urging force of the spring 48, and that proximal end portion is fitted into the retaining hole 49, as shown in FIG. 1. Accordingly, the internal rotor 29 and the driven gear 22 are set in the state in which their relative rotation is restricted.

For the above reason, during the starting of the engine the VVT mechanism 11 is at the position of the most delayed angle and is in the state in which the rotational phase angle is fixed.

Immediately after the starting of the engine, the oil delivered and supplied from the oil pump 15 is insufficient, so that the oil pressure within the hydraulic chambers 13 and 14 is low. For this reason, the internal rotor 29 cannot be fixed, so that the internal rotor 29 can vibrate due to fluctuations of the torque of the intake-side or exhaust-side cam shaft 12 or 23, possibly colliding against the housing 28 or producing abnormal noise due to the collision. However, this situation is prevented since the internal rotor 29 and the driven gear 22 are set in the state in which their relative rotation is restricted by the lock pin 43 and the retaining hole 49.

In addition, oil is not accommodated in the hydraulic chambers 13 and 14 immediately after the starting of the engine, and even if the advanced-angle control is executed in this state to cause the lock pin 43 to be disengaged, the vanes cannot be supported by the oil pressure within the delayed-angle side hydraulic chambers 14, so that the state becomes very unstable. Consequently, the internal rotor 29 can vibrate due to fluctuations of the rotational torque of cam shaft 12, possibly colliding against the housing 28.

To prevent this situation, immediately after the starting of the engine the ECU 17 effects the delayed-angle control by outputting the 0% duty signal for the predetermined time duration, thereby holding the internal rotor 29 at the position of the most delayed angle.

If the advanced-angle control is effected in this state, the operation is changed over to the advanced-angle control from the delayed-angle control at the aforementioned rotational phase angle at which the lock mechanism operates. The ECU 17 executes the auxiliary control mentioned earlier, i.e., the control for outputting the 100% duty signal after the holding duty signal is outputted for the predetermined time duration. Consequently, oil pressure which resists the urging force of the spring 48 constantly acts on the lock pin 43, thereby maintaining the state in which the lock pin 43 is disengaged from the retaining hole 49.

The valve timing controlling apparatus in accordance with the embodiment detailed above has the following characteristic features.

At the time of changeover from the delayed-angle control to the advanced-angle control, it is possible to appropriately avoid the trouble in which the angle advancing operation is hampered by the decline in the oil pressure for urging the lock pin 43 toward the distal end side of the cam shaft 12. This makes it possible to further improve the response characteristic and the reliability of the VVT mechanism 11.

In particular, immediately after the starting of the engine in this embodiment, no oil is accommodated in the advanced-angle side hydraulic chambers 13 and the retaining hole 49, and it takes time to allow the oil pressure within the retaining hole 49 to increase to a sufficient level, so that it is effective to execute the above-described auxiliary control.

Incidentally, this embodiment may be executed by being modified as follows.

In the case of a mechanism in which the lock pin 43 and the retaining hole 49 are aligned with each other at a specific relative angle of rotation other than the position of the most delayed angle, control similar to the auxiliary control described earlier may be executed also when a changeover is effected from the advanced-angle control to the delayed-angle control at the aforementioned specific relative angle of rotation. Namely, control is necessary in which a determination is made as to whether or not the present VVT advanced angle coincides with the aforementioned relative angle of rotation at the time of the changeover of control, and if they coincide, the 0% duty signal is outputted after the holding duty signal is outputted for a fixed time duration.

An arrangement may be adopted in which the internal rotor 29 and the driven gear 22 rotate integrally, and the housing 28 and the cam shaft 12 rotate integrally.

An arrangement may be provided such that the VVT mechanism 11 is provided with a cam pulley, and the pulley is rotated by the rotatively driving force of the crank shaft.

An arrangement may be provided such that not more than three or not less than five vanes 32 are provided.

The housing 28 and the driven gear 22 may be formed integrally. Similarly, the cover 38 and the housing 28 may be formed integrally, and the intake-side cam shaft 12 and the internal rotor 29 may be formed integrally.

The intake-side cam shaft 12 and the housing 28 may be formed integrally, or the driven gear 22 and the internal rotor 29 may be arranged to rotate integrally.

An arrangement may be provided such that the cam pulley 26 is changed to a sprocket, and the timing melt 27 is changed to a timing chain.

A structure may be provided such that the VVT mechanism is provided on the exhaust-side cam shaft so as to alter the opening/closing timing of the exhaust valve. Further, the VVT mechanisms may be provided on both the intake cam shaft 12 and the exhaust cam shaft 23 so as to alter the opening/closing timings of both the intake valve and the exhaust valve.

As described above, in accordance with the present invention, an outstanding advantage can be exhibited in that, in the valve timing controlling apparatus, when the relative rotation of the second rotating body with respect to the first rotating body is effected, the trouble of the lock mechanism being unpreparedly set in a nonallowed state is favorably obviated, thereby further improving the reliability of the valve timing controlling apparatus.

In particular, when the direction of relative rotation of the second rotating body with respect to the first rotating body is changed over, the lock mechanism is temporarily set in the nonallowed state, so that it is possible to prevent the necessary oil pressure from becoming insufficient.

Further, the invention is effective in the valve timing controlling apparatus in which the relative rotation of the second rotating body with respect to the first rotating body is not allowed in the state of a most delayed angle.

What is claimed is:

1. A valve timing controlling apparatus for an internal combustion engine, comprising:

a first rotating body for receiving a rotatively driving force of the internal combustion engine;

a second rotating body whose relative angle of rotation with respect to said first rotating body is displaceable;

relative-angle-of-rotation changing means for changing the relative angle of rotation of said second rotating body with respect to said first rotating body by oil pressure;

locking means including a lock mechanism which is subjected to changeover control by oil pressure between an allowed state in which the relative rotation of said first rotating body and said second rotating body is allowed and a nonallowed state in which it is not allowed in a state of a specific relative angle of rotation of said second rotating body with respect to said first rotating body; and oil-pressure-supply controlling means for controlling the oil pressure for operating said relative-angle-of-rotation changing means and the oil pressure for operating said lock mechanism, so as to transmit the rotatively driving force of the internal combustion engine to a cam shaft for driving the intake valve or the exhaust valve by means of said first rotating body and said second rotating body, wherein the relative angle of rotation is controlled by effecting any one of first oil pressure control for delaying the relative angle of rotation of said second rotating body, second oil pressure control for advancing the relative angle of rotation of said second rotating body, and third oil pressure control for holding the relative angle of rotation of said second rotating body, said lock mechanism is restricted to the allowed state by at least the third oil pressure control, said lock mechanism is restricted to the nonallowed state when none of the first oil pressure control, the second oil pressure control, and the third oil pressure control is effected, and when the first oil pressure control or the second oil pressure control is started in the state of the specific relative angle of rotation, the third oil pressure control is effected to set said lock mechanism in the allowed state before effecting the first oil pressure control or the second oil pressure control.

2. The valve timing controlling apparatus for an internal combustion engine according to claim 1, wherein when a changeover is effected from one of the first oil pressure control and the second oil pressure control to the other control, the third oil pressure control is effected to set said lock mechanism in the allowed state before effecting the other oil pressure control.

3. The valve timing controlling apparatus for an internal combustion engine according to claim 2, wherein the specific relative angle of rotation is in a state of a most delayed angle, and when the second oil pressure control is started, the third oil pressure control is effected to set said lock mechanism in the allowed state before effecting the second oil pressure control.

4. The valve timing controlling apparatus for an internal combustion engine according to claim 1, wherein the specific relative angle of rotation is in a state of a most delayed angle, and when the second oil pressure control is started, the third oil pressure control is effected to set said lock mechanism in the allowed state before effecting the second oil pressure control.

* * * * *

UNITED STATES PATENT AND TRADEMARK OFFICE

CERTIFICATE OF CORRECTION

PATENT NO. : 6,006,708

DATED : December 28, 1999

INVENTOR(S) : Ken ASAKURA; Mikame KAZUHISA

It is certified that error appears in the above-identified patent and that said Letters Patent is hereby corrected as shown below:

Title page

Below "United States Patent [19]"

please change "Ken et al." to --Asakura et al.--.

[75] Inventors: Should read

--Ken Asakura, Toyota; Kazuhisa Mikame, Nagoya, both of Japan--..

Signed and Sealed this

Thirtieth Day of January, 2001

*Attest:*

Q. TODD DICKINSON

*Attesting Officer*

*Director of Patents and Trademarks*